United States Patent [19]

Bayle et al.

[11] Patent Number: 4,622,129

[45] Date of Patent: Nov. 11, 1986

[54] PROCESS FOR THE MANUFACTURE OF LUBRICATING BASE OILS

[75] Inventors: Gerhard G. Bayle, Amsterdam, Netherlands; Henricus M. J. Bijwaard, Le Petite Couronne; Martinus M. P. Janssen, Grand Couronne, both of France

[73] Assignee: Shell Oil Company, Houston, Tex.

[21] Appl. No.: 786,786

[22] Filed: Oct. 11, 1985

[30] Foreign Application Priority Data

Oct. 12, 1984 [GB] United Kingdom ..... 8425837

[51] Int. Cl.[4] ..... C10G 67/04; C10G 67/14

[52] U.S. Cl. ..... 208/87; 208/18; 208/36; 208/254 H; 208/254 R

[58] Field of Search ..... 208/87, 89, 254 H, 18, 208/254 R, 36

[56] References Cited

U.S. PATENT DOCUMENTS

| | | | |
|---|---|---|---|
| 3,663,422 | 5/1972 | Dun et al. | 208/28 |
| 3,702,817 | 11/1972 | Cummins et al. | 208/87 |
| 3,779,896 | 12/1973 | Woodle | 208/18 |
| 3,816,295 | 6/1974 | Coleman et al. | 208/18 |
| 3,880,747 | 4/1975 | Mills et al. | 208/87 |
| 3,929,616 | 12/1975 | Mead et al. | 208/18 |
| 4,229,282 | 10/1980 | Peters et al. | 208/87 |
| 4,259,174 | 3/1981 | Chen et al. | 208/87 |
| 4,261,813 | 4/1981 | Smith | 208/254 H |
| 4,272,362 | 6/1981 | Schneider et al. | 208/87 |
| 4,297,206 | 10/1981 | Scheibel | 208/254 R |
| 4,372,839 | 2/1983 | Oleck et al. | 208/18 |
| 4,426,280 | 1/1984 | Chen et al. | 208/254 R |

FOREIGN PATENT DOCUMENTS

| | | | |
|---|---|---|---|
| 2059433 | 4/1981 | United Kingdom | 208/87 |

*Primary Examiner*—Andrew H. Metz
*Assistant Examiner*—Anthony McFarlane
*Attorney, Agent, or Firm*—Kimbley L. Muller

[57] ABSTRACT

A process is disclosed for the manufacture of lubricating base oils from nitrogen-containing distillates and/or deasphalted oils by subjecting them to a catalytic hydrotreatment which may be followed by a dewaxing treatment, wherein distillates and/or deasphalted oils having a nitrogen content which numerically expressed exceeds the value $f \cdot P_{H2} \cdot S_v^{-1}$, wherein f is a constant relating to the viscosity of the final base oil, $P_{H2}$ represents the hydrogen partial pressure in bar applied in the catalytic hydrotreatment and $S_v$ represents the weighted hourly space velocity in $t/m^3 \cdot h$ at which the catalytic hydrotreatment is carried out, are subjected to a preceding solvent extraction.

21 Claims, No Drawings

PROCESS FOR THE MANUFACTURE OF LUBRICATING BASE OILS

FIELD OF THE INVENTION

The present invention relates to the manufacture of lubricating base oils as well as to lubricating base oils thus prepared. Lubricating base oils which are used to formulate engine lubricants and industrial oils are normally prepared from suitable petroleum feedstocks, in particular from (vacuum) distillates or deasphalted vacuum residues or mixtures thereof.

In the art of lubricating oil manufacture it is a major objective to produce a lubricating base oil having a predetermined set of properties, such as, for example, viscosity, oxidation stability and maintenance of fluidity over a wide range of temperatures. It is of paramount importance to be able to produce high quality lubricating base oils as consistently as possible. This can be achieved when a well-known starting material can be processed under well-known conditions using well-known techniques. A number of physical as well as catalytic treatments can be employed to produce suitable lubricating base oils.

In the conventional production of lubricating base oils from petroleum feedstocks, fractions obtained from a crude oil and boiling in the desired lubricating base oil range (each range having a separate viscosity range) are separately treated with a suitable solvent to remove primarily undesired aromatic compounds present in the fractions and affecting the properties thereof. Such solvent extraction processes (using, for instance, furfural, phenol or sulphur dioxide as the extractant) produce lubricating oil raffinates and aromatic extracts.

A nonconventional approach to the preparation of lubricating base oils comprises the catalytic hydrotreatment of suitable feedstocks. The catalyst hydrogenation is normally carried out at rather severe conditions, e.g. at temperatures up to 500° C., and hydrogen pressures up to 200 bar using hydrogenation catalysts such as molydenum, chromium, tungsten, vanadium, platinum, nickel, copper, iron or cobalt either as such or in the form of their oxides and/or sulphides and either supported on a suitable carrier such as alumina or silica or unsupported. Lubricating base oils having a higher viscosity index are thus prepared as the amount of polyaromatic compounds present is reduced substantially. Also sulphur and nitrogen compounds present in the feedstock to be hydrogenated will be reduced to a very large extent, typically for more than 90%.

Normally, for paraffinic crudes as lube oil feedstock, a dewaxing treatment is carried out after the solvent extraction process or the hydrogenation process to improve (i.e. to reduce) the pour point of the resulting lubricating base oil. Both solvent dewaxing and catalytic dewaxing can be applied. In the past acid treatments and/or clay treatments have been used to improve the resistance to oxidation of the product and to further improve the color and color stability of the product. Also a rather mild hydrogenation (also referred to as hydrofinishing) of raffinates has often been applied to this context.

BACKGROUND OF THE INVENTION

Combinations of various treatments have been suggested extensively in the art with a view to improving one or more properties of the lubricating base oil to be produced. For instance, reference is made in U.S. Pat. No. 3,256,175 to a process wherein a light distillate fraction of a crude oil is subjected to solvent extraction to give a light raffinate and a light aromatic extract, whilst a heavy distillate fraction is also solvent extracted to obtain a heavy raffinate and a heavy aromatic extract, which latter extract is at least partially subjected to a severe hydrogenation treatment and wherein at least a portion of the oil thus hydrogenated is combined with the earlier produced light raffinate. In this integrated process both the aromatic compounds and the nitrogen compounds are removed virtually complete, i.e. for more than 97%.

A combined solvent extraction-dewaxing-hydrorefining process to produce improved viscosity index lubricating base oils is described in U.S. Pat. No. 3,702,817. The hydrorefined extract is combined with the reactant stream prior to its introduction into the dewaxing stage of the process.

A combination of a catalytic dewaxing treatment to effectively reduce the pour point of a lubricating oil base stock to below −9° C., followed by a catalytic hydrotreatment in order to increase the viscosity index of the lubricating oil fraction of the dewaxed oil and recovering therefrom a high viscosity index lubricating base oil stock having a pour point not higher than −4° C. is described in European patent specification No. 43,681.

Also the technique of blending different lubricating base oils which have been subjected to one or more (pre)-treatments in order to improve the oxidation stability of the resulting mixture can be used advantageously, for instance as described in British patent specification No. 2,024,852.

Since the respective treatments will contribute differently to the total spectrum of properties of the lubricating base oils to be produced, as they are likely whilst improving one desired property to deteriorate others, it requires a lot of skill to produce high quality lubricating base oils of constant quality. Many times synthetic additives have to be introduced into the base oil in order to obtain a lubricating oil of acceptable quality.

OBJECTS AND EMBODIMENTS

It will be clear from the above that the objective to consistently produce high quality lubricating base oils is a challenging one which becomes increasingly difficult when it appears to be necessary to change from a well-known feedstock to a lesser known one and which is unlikely to be achieved at all when only hitherto less suitable or even unsuitable feedstocks have to be processed. This is becoming of even more interest as there is s strong incentive to improve the flexibility of lubricating base oil manufacture so that refinery facilities can be adequately adapted to sudden changes in supply and/or prices. At the same time, the refiner is confronted with the problem that both under- and over-extracting of the starting material affect the quality of the intermediate raffinate, which is also likely to be affected by under- or over-refining in the subsequent hydroprocessing stage which would affect the quality and, in particular, the yield of the final lubricating base oil.

DESCRIPTION OF THE INVENTION

It has now been found that by carefully adjusting the extraction depth of the base stocks to be hydroprocessed it is now possible to manufacture for the vast majority of lubricants serving in numerous applications the appropriate base oil in high yield and at constant product quality. It is, moreover, possible to do so by choosing from a wide variety of crude oils ranging from a well processable crude oil like Arabian Light to notoriously difficult crude oils like Iranian Heavy and Maya.

The present invention therefore relates to a process for the manufacture of lubricating base oils from nitrogen containing distillates and/or deasphalted oils by subjecting them to a catalytic hydrotreatment which may be followed by a dewaxing treatment, in which distillates and/or deasphalted oils having a nitrogen content which numerically expressed exceeds the value $f \cdot P_{H2} \cdot S_v^{-1}$, wherein f is a constant relating to the viscosity of the final base oil, $P_{H2}$ represents the hydrogen partial pressure in bar applied in the catalytic hydrotreatment and $S_v$ represents the weighted hourly space velocity in $t/m^3 \cdot h$ at which the catalytic hydrotreatment is carried out, are subjected to a preceding solvent extraction.

The careful adjustment of the extraction depth of the process according to the present invention has the important advantage that crude oils which are extremely difficult to process can now be processed to give high quality base oils in surprisingly high yields. Compared with solvent extraction it appears that the process according to the present invention gives a base oil yield increase on crude of at least 40% for the production of a base oil package of predetermined viscosity (e.g. 11.3 cSt at 100° C.).

Difficult crude oils such as Iranian Heavy can now be processed to give high quality base oils at yields even exceeding those obtainable via solvent extraction from well-known Arabian lube oil crudes. It also means that the flexibility of the operation has been increased substantially since less lube oil crude or long residue has to be processed as would be the case when only a solvent extraction stage were to be applied. It should also be noted that significantly less of a lower-viscosity fuel blending compound is coproduced for each ton of base oil manufactured at comparable utility requirements.

The process according to the present invention is suitably carried out in such a way that the amount of nitrogen present in the raffinate (expressed in mg/kg) to be hydrotreated is between 0.3 and 0.95 times the numerical value referred to hereinbefore and preferably in such a way that the amount of nitrogen present in the raffinate to be hydrotreated is between 0.4 and 0.9 times said value.

As discussed hereinbefore, a wide variety of crude oils can be used to produce the distillates and/or the deasphalted oils to be processed according to the present invention. If desired, the starting materials may be subjected to a demetallization/-desulphurization treatment prior to their use in the process according to the present invention. When distillates originating from paraffinic crudes are to be used, they can be suitably subjected to a dewaxing treatment, in particular a solvent dewaxing treatment, prior to their use in the process according to the present invention.

Examples of crude oils which can be applied in the manufacture of lubricating base oils according to the present invention include Arabian Light, Arabian Heavy, Kuwait, Brent, Isthmus, Lagocinco, Iranian Heavy and Maya. Suitable starting materials are (dewaxed) distillates of such crude oils, which in the form of the appropriate 500 neutral distillates may contain nitrogen in an amount ranging from 1,000 ppmw (=1,000 mg/kg) (e.g. Arabian Light) to 2,500 ppmw (Iranian Heavy) and sulphur in an amount ranging from 0.7% w (Brent) to 3.5% w (Kuwait).

The solvent extraction stage of the process according to the present invention is suitably carried out with solvents such as furfural, phenol or N-Methyl-2-pyrrolidone, all having boiling points well below the boiling range of the lubricating base oils so that separation and recovery of the solvent applied is possible by simple flashing. Preference is given to the use of furfural as extractant. In view of the high cost of solvent recovery and the relatively low value of the extract produced, it is important that the maximum amount of raffinate should be produced with the minimum use of solvent. Very good results can be obtained using a rotating disc contactor in the extraction process, especially when the temperature at which the extraction process is carried out is carefully maintained.

The solvent extraction is normally carried out for furfural at temperatures in the range of from 50°–135° C., depending on the type of (dewaxed) distillate to be extracted. Relatively lower boiling distillates are extracted at lower temperatures than higher boiling distillates. Solvent/feed ratios of from 0.4 to 4 can be normally applied for furfural as extractant. By carefully adjusting the temperature and/or the solvent/feed ratio to be applied, the extraction depth can be set at the required level. By raising the temperature and/or the solvent/feed ratio the extraction depth will be increased.

If the solvent extraction is to be applied to a residual oil fraction, asphalt should be first removed from it. Deasphalting can be very suitably effected by contacting the residual lubricating oil fraction at elevated temperature and pressure with an excess of a lower hydrocarbon such as propane, butane, pentane or mixtures thereof. Propane and butane are preferred for this purpose. Suitable process conditions, e.g. for propane and butane comprise a pressure in the range of from 20–100 bar, a temperature in the range of from 50° C. to 155° C. and a solvent/oil weight ratio in the range of from 7:1 to 1:1.

As described hereinbefore, (dewaxed) distillates and/or deasphalted oils having an amount of nitrogen (in mg/kg, =parts per million by weight=ppmw) which numerically expressed exceeds the value of $f \cdot P_{H2} \cdot S_v^{-1}$ are subjected to solvent extraction to reduce the amount of nitrogen to a value below said maximum allowable value. Preferably, the solvent extraction is carried out to reduce the amount of nitrogen present in the material to be subjected to hydrotreatment to a value which is between 0.3 and 0.95 times, and in particular between 0.4 and 0.9 times said value.

The value of the numerical expression $f \cdot P_{H2} \cdot S_v^{-1}$ for any given distillate and/or deasphalted oil to be processed can be found by multiplying the value of the constant f, which is directly related to the viscosity of the high quality lubricating base oil to be produced (as explained hereinafter) with the product of the partial hydrogen pressure to be applied in the hydrotreatment state and the reciprocal of weighted hourly space velocity to be applied in the hydrotreatment. When, for instance, from a certain distillate such as a 500 neutral distillate originating from Arabian Light and having a nitrogen content of 1,000 ppmw a lubricating base oil is to be prepared for which f equals 3.5 and the selected hydrogenating conditions include a partial hydrogen pressure of 120 bar and a space velocity of 0.8 $ton/m^3 \cdot h$, the numerical expression $f \cdot P_{H2} \cdot S_v^{-1}$ amounts to 525, indicating that the amount of nitrogen has to be reduced in the solvent extraction stage from 1,000 to a value below 525.

It should be noted that it is the advantage of the process according to the present invention that there is no need to reduce the amount of nitrogen in the distillate and/or the deasphalted oil to be processed as far as possible. On the contrary, this would lead to substantial over-extraction which would badly affect the resulting base oil quality and yield. It should also be noted that far from optimum results would be obtained if a partial removal of nitrogen were to be applied but not to a value below the critical value determined via the expression $f \cdot P_{H2} \cdot S_v^{-1}$ as discussed hereinbefore. A considerable decrease in high quality base oil yield would be experienced if partial but insuffient nitrogen removal had taken place.

The value of f to be used to determine the level of nitrogen compounds allowable in a raffinate prior to hydroprocessing (which level has at least to be reached by solvent extraction of a distillate or a deasphalted oil) is a factor which is directly related to the viscosity of the final lubricating base oil to be obtained. When distillates are to be processed according to the present invention, this value for f is found by substituting the kinematic viscosity (in cSt at 100° C.; expressed as $V_{100}$) of the final lubricating base oil in the expression $2.15+0.12\times V_{100}$. Normally, for lubricating base oils produced from distillate the viscosity at 100° C. will range from 3 to 20. For instance, when a lubricating base oil having a viscosity of 7.05 cSt (=7.05 $mm^2/s$) at 100° C. is to be prepared from a 250 neutral distillate, the value for f will be 3. When Bright Stocks are to be processed according the the present invention the value for f amounts to 4.5.

The hydroprocessing stage of the process according to the present invention can be carried out suitably at a temperature in the range of from 290° C. to 425° C., preferably in the range of from 310° C. to 400° C. and most preferably in the range from 325° C. to 380° C. Hydrogen pressures in the range of from 80 to 200 bar can be suitably applied. Preference is given to the use of pressures in the range of from 90 to 160 bar, in particular in the range of from 90 to 160 bar. The hydroprocessing stage according to the present invention is suitably applied at a space velocity of 0.5 to 1.5 $t/m^3 \cdot h$. Preference is given to the use of a space velocity in the range of 0.5 to 1.2 $t/m^3/h$. The relation between the hydrogen partial pressure, the space velocity and the factor f has to be satisfied in order to be able to constantly produce high quality lubricating base oils.

Pure hydrogen may be used but a gas with a hydrogen content of 60% or more by volume is perfectly suitable for this process. In practice it will be preferable to use a hydrogen-containing gas originating from a catalytic reforming plant. Such a gas not only has a high hydrogen content but also contains low-boiling hydrocarbons, for example methane, and a small quantity of propane. The hydrogen/oil ratio to be applied is suitably in the range between 300 and 5,000 standard liters (liters at 1 bar and 0° C.) per kg of oil. Preference is given to the use of hydrogen/oil ratios between 500 and 2,500 standard liters per kg of oil, in particular between 500 to 2,000 standard liters per kg of oil.

Catalysts which can be suitably applied in the hydroprocessing stage of the process according to the present invention comprise one or more metals of Groups VIB and VIII of the Periodic Table of the Elements, or sulphides or oxides thereof, which may be supported on a carrier comprising one or more oxides of elements of Groups II, III and IV of the Periodic Table of the Elements. The catalysts may also comprise one or more of the metals molybdenum, chromium, tungsten, platinum, nickel, iron and cobalt or their oxides and/or sulphides, either supported on a suitable carrier, or unsupported. Particularly advantageous catalysts comprise combinations of one or more Group VI B metals (chromium, molybdenum and tungsten) such as cobalt and molybdenum, nickel and tungsten and nickel and molybdenum supported on alumina.

The catalysts are preferably used in their sulphidic form. Sulphidation of the catalysts may be affected by any one of the techniques for sulphidation of catalysts well known in the art. Sulphidation may, for instance, be carried out by contacting the catalysts with a sulphur-containing gas, such as a mixture of hydrogen and hydrogen sulfide, a mixture and hydrogen and carbon disulphide or a mixture of hydrogen and a mercaptan, such as butyl mercaptan. Sulphidation may also be carried out by contacting the catalyst with hydrogen and a sulphur-containing hydrocarbon oil, such as a sulphur containing kerosine or gas oil.

The catalysts may also contain one or more promotors. Suitable promotors comprise compounds containing phosphorus, fluorine or boron. The use of thes promotors is highly advantageous in terms of catalyst activity, selectivity and stability.

Examples of suitable supports for the catalysts to be used in the hydroprocessing stage comprise silica, alumina, zirconia, thoria and boria, as well as mixtures of these oxides, such as silica-alumina, silica-magnesia and silica-zirconia. Preference is given to catalysts comprising as carrier material alumina.

The metals or metal compounds may be incorporated into catalysts by any one of the techniques for the preparation of supported catalysts well known in the art. The metals or metal compounds are preferably incorporated into the catalysts by (co)-impregnation of a carrier in one or more metal compounds, followed by drying and calcining. If the impregnation is carried out in several steps, the material may be dried and calcined between the successive impregnation steps.

The amounts of the metals present in the catalysts may vary between the wide limits. Very suitable, the catalysts contain at least 10 parts by weight of a group VI B metal and/or at least 3 parts by weight of a Group VIII metal per 100 parts by weight of a Group VI B metal and/or a Group VIII metal per 100 parts by weight of carrier can also be used.

Preferred catalysts to be used in the hydroprocessing stage of the process according to the present invention are those described in British patent specification No. 1,493,620 and 1,546,398. The catalysts described therein are fluorine-containing catalysts containing either nickel and/or cobalt and, in addition, molybdenum, nickel and tungsten on alumina as carrier, which catalysts have a compacted bulk density of at least 0.8 g/ml, comprise at least 3 parts by weight of nickel and/or cobalt, 10 parts by weight of molybdenum and 20 parts by weight of tungsten, respectively, per 100 parts by weight of carrier, and have been prepared from alumina hydrogel from which, by drying and calcining, a xerogel can be obtained having a compacted bulk density of less than 0.8 g/ml and wherein the preparation of the catalyst is effected (a) if the pore volume quotient of the said xerogel is at least 0.5 either
  (i) by drying and calcining the alumina hydrogel, incorporation of nickel and tungsten into the xerogel and once more drying and calcining the composition, or
  (ii) by incorporation of the metals into the alumina hydrogel, and drying and calcining the compositions; or
(b) if the pore volume quotient of the said xerogel is less than 0.5 either
  (i) by incorporation of at least part of the fluorine into the alumina hydrogel, and drying and calcining the composition, incorporation of nickel and tungsten into the xerogel and once more drying and calcining the composition; or
  (ii) by incorporation of the metals and at least a part of the fluorine into the alumina hydrogel, and drying and calcining the composition; a further condition being that if inthe catalyst preparation the starting material is an alumina hydrogel with a pore volume quotient of less than 0.5 sufficient fluorine should be incorporated into the alumina hydrogel to produce from this fluorine-containing alumina hydrogel, by drying and calcining, a xerogel having a port volume quotient of at least 0.5 (For a further description of the pore volume quotient reference ismade to the above-mentioned British Patent Specifications).

If the hydroprocessing stage of the process according to the present invention a catalyst is employed comprising nickel and tungsten and which has been prepared by the xerogel route (i.e. by incorporation of the metals into the xerogel) preference is given to a catalyst comprising 3–12 parts by weight of nickel and 20–75 parts by weight of tungsten per 100 parts by weight of alumina and in particular to such a catalyst in which the nickel-to-tungsten weight ratio is between 1:5 and 1:7.

If in the hydroprocessing stage of the process according to the present invention a catalyst is employed comprising nickel and tungsten and which has been prepared by the hydrogel route (i.e. by incorporation of the metals into the hydrogel), preference is given to a catalyst comprising 25–50 parts by weight of alumina and in particular to such a catalyst in which the nickel-to-tungsten weight ratio is between 1:1.5 and 1:5.

If in the hydroprocessing state of the process according to the present invention a catalyst is employed comprising nickel and/or cobalt, and, in addition, molybdenum, preference is given to a catalyst comprising 25–80 parts by weight of nickel and/or cobalt and 50–80 parts by weight of molybdenum per 100 parts by weight of alumina and in particular to such a catalyst in which the weight ratio betwen nickel and/or cobalt on the one hand and molybdenum on the other is between 1:1 and 1:5.

The quantity of fluorine present in the aforementioned catalyst is preferably 0.5–10 parts by weight per 100 parts by weight of alumina if they have been prepared by the xerogel route and 10–25 parts by weight per 100 parts by weight of alumina if they have been prepared by the hydrogel route.

Part of all of the fluorine compound, as the case may be, may very suitably be incorporated into the catalyst by in-situ fluorination which may be carried out by adding a suitable fluorine compound, such as o-fluorotoluene or difluoroethane to the gas and/or liquid stream which is passed over the catalyst.

Part or all of the hydrotreated products obtained by the process according to the present invention may be subjected, if desired, to a dewaxing treatment to further improve the properties of the final lubricating base oils. Suitable dewaxing treatments are solvent dewaxing and catalytic dewaxing. It is also possible to subject some hydrotreated products to solvent dewaxing and others, in particular higher boiling hydrotreated products to catalytic dewaxing or to precede a catalytic dewaxing by a solvent dewaxing.

Solvent dewaxing is suitably carried out by using two solvents, one of which dissolves the oil and maintains fluidity at low temperatures (methyl isobutyl ketone and, in particular, toluene being well-known solvents for this purpose). Propane and chlorinated hydrocarbons such as dichloromethane can also be used. Normally, the product to be dewaxed is mixed with the solvents and heated to ensure solution. The mixture isthen cooled down to filtration temperature, usually in the range of from −10° C. to −40° C. The cooled mixture is then filtrated and the separated wax washed with cooled solvent. Finally, the solvents are recovered from the dewaxed oil and from the separated wax by filtration and recirculation of the solvents into the process.

Catalytic dewaxing is suitably carried out by contacting the hydrotreated product produced according to the process according to the present invention in the presence of hydrogen with an appropriate catalyst. Suitable catalysts comprise crystalline aluminium silicates such as ZSM-5 and related compounds, e.g. ZSM-8, ZSM-11, ZSM-23 and ZSM-35 as well as ferrierite type compounds. Good results can also be obtained using composite crystalline aluminium silicates wherein various crystalline structure appear to be present.

The catalytic hydrodewaxing may very suitably be carried out at a temperature of from 250°–500° C., a hydrogen pressure of from 5–100 bar, a space velocity of from 0.1–5.0 $kg.l.^{-1}h^{-1}$ and a hydrogen/oil ratio of from 100–2500 standard liters per kilogram of oil. The catalytic hydrodewaxing is preferably carried out at a temperature of from 275°–450° C., a hydrogen pressure of from 10–75 bar, a space velocity of from 0.2–3 $kg.l^{-1}h^{-1}$ and a hydrogen/oil ratio of from 200–2,000 standard liters per kilogram.

However, in case solvent dewaxing is applied and slack was is thus co-produced in the dewaxing treatment, it may be advantageous to subject at least part of the slack was produced to a hydrogen treatment, preferably to a hydrogen treatment as discussed hereinbefore to isomerize/mildly hydrocrack these waxes into an isoparaffinic base oil of extra high viscosity index, e.g. exceeding 140 as described in British Patent Specification No. 1,429,291.

It is also possible, though not required, to subject the lubricating base oils manufactured in accordance with the present invention to an after-treatment, e.g. a hydrofinishing treatment using rather mild hydrogenation conditions or mild extraction to improve certain properties, e.g. resistance to oxidation.

It may also be useful to add small amounts of other lubricating base oil fractions or precursors thereof to constitute a certain base oil with preset properties, if desired prior to subjecting the lubricating base oil to its final dewaxing treatment.

The base oil (fractions) produced according to the process according to the present invention can be suitably applied to formulate lubricating oils for many applications, if desired together with one or more base oil fractions of adequate quality which have been obtained via different processes.

EXAMPLES

The invention will now be illustrated by reference to the following examples which should not be construed as a limitation on the breadth of this invention.

EXAMPLE 1

In order to produce a 500 neutral base oil having a kinematic viscosity of 10.9 cSt at 100° C., a 500 neutral distillate obtained from an Arabian Heavy crude oil having a total organic nitrogen content of 950 mg/kg was subjected to a furfural extraction treatment prior to catalytic hydrotreatment. The extraction was carried out at a temperature of 85° C. and a solvent/feed ratio of 0.8.

The intermediate waxy raffinate produced has a total organic nitrogen content of 410 mg/kg. The intermediate waxy raffinate was then catalytically hydrotreated using a fluorided nickel/tungsten on alumina catalyst containing 5% w of nickel, 23% w of tungsten (expressed on initial oxidic catalyst) and 3% w of fluorine. The catalytic hydrotreatment was carried out at a hydrogen partial pressure at the reactor inlet of 140 bar, a space velocity of 0.74 t/m$^3$ and at a temperature of 366° C.

After solvent dewaxing of the redistilled total liquid product obtained by the catalytic hydrotreatment, a 500 neutral base oil was produced in a yield of 53% on 500 neutral distillate intake. The 500 neutral base oil had a pour point below −9° C. and a VI (viscosity index) of 95. This base oil performed adequately in standard oxidation tests. The required minimum extraction depth according to the expression $f \cdot P_{H2} \cdot S_v^{-1}$, wherein f has been determined as defined hereinbefore, corresponds to a waxy raffinate having a nitrogen content of 654 mg/kg. This means that 500 neutral distillate had been solvent extracted to 0.63 times the maximum allowable nitrogen content.

A 500 neutral base oil having a kinetic viscosity of 11.2 cSt at 100° C. was produced from a 500 neutral distillate obtained from a similiar Arabian Heavy crude oil having a total organic nitrogen content of 940 mg/kg by applying only solvent extraction. The furfural extraction was carried out at a temperature of 110° C. and a furfural/feed ratio of 2.7. The base oil thus prepared had a comparable VI and performed equivalent in standard oxidation tests. In this case 91% of the total organic nitrogen content had been removed, whilst the yield on 500 neutral distillate amounted to only 41%.

EXAMPLE 2

In order to produce a 250 neutral base oil having a kinematic viscosity of 7.7 cSt at 100° C., a 250 neutral distillate obtained from an Arabian Heavy crude oil having a total organic nitrogen content of 760 mg/kg was subjected to a furfural extraction prior to catalytic hydrotreatment. The extraction was carried out at a temperature of 81° C. and a solvent/feed ratio of 1.4.

The intermediate waxy raffinate produced had a total organic nitrogen conent of 180 mg/kg. The intermediate waxy raffinate was then catalytically hydrotreated with a catalyst as described in Example 1. The catalytic hydrotreatment was carried out at a hydrogen partial pressure at the reactor inlet of 140 bar, a space velocity of 0.73 t/m$^3$·h and at a temperature of 350° C.

After solvent dewaxing of the redistilled total liquid product obtained by the catalytic hydrotreatment, a 250 neutral base oil was produced in a yield of 59.8% on 250 neutral distillate intake. The 250 neutral base oil had a pour point below −9° C. and a VI of 97. This base oil performed adequately in standard oxidation tests. The required minimum extraction depth according to the expression $f \cdot P_{H2} \cdot S_v^{-1}$, wherein f has been determined as defined hereinbefore, corresponds to a waxy raffinate having a total organic nitrogen content of 589 mg/kg. This means that the 250 neutral distillate had been solvent extracted to 0.30 times the maximum allowable nitrogen content.

A 250 neutral base oil having a viscosity of 7.3 cSt at 100° C. was produced from a 250 neutral distillate obtained from an Arabian Heavy crude oil having a total organic nitrogen content of 610 mg/kg by applying only solvent extraction. The furfural extraction was carried out at a temperature of 95° C. and a solvent/feed ratio of 2.6. This base oil thus prepared had a comparable VI and performed equivalently in standard oxidation tests. In this case 92% of the total organic nitrogen content had been removed, whilst the yield on 250 neutral distillate amounted to 44.5%.

EXAMPLE 3

In order to produce a Bright Stock having a kinematic viscosity of 29.5 cSt at 100° C., a deasphalted oil obtained from a crude oil having a total organic nitrogen content of 1880 mg/kg was subjected to furfural extraction prior to catalytic hydrotreatment. The extraction was carried out at a temperature of 110° C. and a solvent/feed ratio of 2.4.

The intermediate waxy raffinate produced has a total organic nitrogen content of 820 mg/kg. The intermediate waxy raffinate was then catalytically hydrotreated with a catalyst as described in Example 1. The catalytic hydrotreatment was carried out at a hydrogen partial pressure at reactor inlet of 140 bar, a space velocity of 0.6 t/m$^3$·h and at a temperature of 374° C.

After solvent dewaxing of the redistilled total liquid product obtained by the catalytic hydrotreatment, a Bright Stock was produced in a yield of 51% on deasphalted oil intake. The Bright Stock had a pour point below −9° C. and a VI of 96. This base oil performed adequately in standard oxidation tests. The required minimum extraction depth according to the expression $f \cdot P_{H2} \cdot S_v^{-1}$, wherein f has the value 4.5, corresponds to a waxy raffinate having a total organic nitrogen content of 1050 mg/kg. This means that the deasphalted oil had been solvent extracted to 0.78 times the maximum allowable nitrogen content.

A Bright Stock having a viscosity of 35 cSt at 100° C. was produced from a deasphalted oil obtained from a crude oil having a total organic nitrogen content of 1700 mg/kg by applying only solvent extraction. The furfural extraction was carried out at a temperature of 140° C. and a solvent/feed ratio of 2.9. The Bright Stock thus prepared had a comparable VI and performed equivalently in standard oxidation tests. In this case 82% of the total organic nitrogen content had been removed, whilst the yield on deasphalted oil amount to 41%.

EXAMPLE 4

In order to produce a 500 neutral base oil having a kinematic viscosity of 11.25 cSt at 100° C., a 500 neutral distillate obtained from an Iranian Heavy crude oil having a total organic nitrogen content of 2430 mg/kg was subjected to a furfural extraction prior to catalytic hydrotreatment. The extraction was carried out at a temperature of 90° C. and a solvent/feed ratio of 0.9.

The intermediate waxy raffinate produced had a total organic nitrogen content of 543 mg/kg. The intermediate waxy raffinate was then catalytically hydrotreated with a catalyst as described in Example 1. The catalytic hydrotreatment was carried out at a hydrogen partial pressure at reactor inlet of 140 bar, a space velocity of 0.8 $t/m^3 \cdot h$ and at a temperature of 375° C.

After solvent dewaxing of the redistilled total liquid product obtained by the catalytic hydrotreatment, a 500 neutral base oil was produced in a yield of 46% on 500 neutral distillate. The 500 neutral base oil had a pour point below −9° C. and a VI of 96. This base oil performed adequately in standard oxidation tests. The required minimum extraction depth according to the expression $f \cdot P_{H2} \cdot S_v^{-1}$, wherein f has been determined as defined hereinbefore, corresponds to a waxy raffinate having a total organic nitrogen content of 612 mg/kg. This means that the 500 neutral distillate had been solvent extracted to 0.89 times the maximum allowable nitrogen content.

By applying a conventional solvent extraction on the same type of distillate to produce the same high quality product, a severe loss in base oil yield is experienced. Only a base oil yield of about 20% on neutral distillate intake is obtainable. Moreover, a much higher solvent-/feed ratio has to be applied to meet the quality required of a satisfactory 500 neutral base oil.

EXAMPLE 5

As a measure for the performance with respect to resistance to oxidation, the base oils produced in accordance with the process according to the present invention as described in the previous examples were subjected to the oxidation last described in J. Inst. Petr. 48 (1962). In this test the inhibited oxidation stability is calculated as the induction period in minutes. A minimum value of 100 minutes is required. The induction periods for the base oils produced according to the present inventin as described in the Examples 1–4 amounted to 127, 160, 158 and 137, respectively.

We claim as our invention:

1. A process for the manufacture of lubricating base oils from nitrogen-containing distillate oil or a nitrogen-containing deasphalted oil by treating said oil to catalytic hydrotreatment in the presence of hydrogen and a catalytic composition of matter at catalytic hydrotreatment conditions in a catalytic hydrotreatment zone, passing said hydrotreated oil from said catalytic hydrotreatment zone to a dewaxing treatment zone and dewaxing said distillate oil or said deasphalted oil, wherein said oil which possesses a nitrogen content exceeding the value of $(f)(P_{H2})(S_v)^{-1}$, wherein:

f=is equal to $2.15+0.12 \times V_{100}$ wherein $V_{100}$ is equal to the kinematic viscosity of the resultant lubricating base oil expressed in centistokes (cSt) at 100° C.;

$P_{H2}$=is equal to the hydrogen partial pressure in bar existent in said catalytic hydrotreatment zone; and $S_v$=is equal to weight hourly space velocity in $t/m^3(h)$ in said catalytic hydrotreatment zone is subjected to solvent extraction prior to said hydrotreatment at severities sufficient to reduce said nitrogen content to a value less than said value of $(f)(P_{H2})(S_v)^{-1}$.

2. The process of claim 1 wherein said solvent extraction reduces the nitrogen value prior to hydrotreatment to between 0.3 and 0.95 times said value of nitrogen content determined by said expression of $(f)(P_{H2})(S_v)^{-1}$.

3. The process of claim 1 wherein said solvent extraction reduces the nitrogen value prior to hydrotreatment to between 0.4 to 0.90 times said value of nitrogen content determined by said expression of $(f)(P_{H2})(S_v)^{-1}$.

4. The process of claim 1 wherein said solvent extraction is carried out in the presence of a solvent selected from the group consisting of furfural, phenol and N-methyl-2-pyrrolidine.

5. The process of claim 1 wherein said solvent extraction is carried out in the presence of a furfural solvent at a temperature in the range of from 50° C. to 135° C. and at a solvent/oil ratio of from 0.4 to 4.

6. The process of claim 1 wherein said solvent extraction is carried out in the presence of a N-methyl-2-pyrrolidine solvent at a temperature in the range of from 50° C. to 135° C. and at a solvent/oil ratio of from 0.4 to 4.

7. The process of claim 1 wherein said solvent extraction is carried out in the presence of a phenol solvent at a temperature in the range of from 50° C. to 135° C. and at a solvent/oil ratio of from 0.4 to 4.

8. The process of claim 1 wherein said catalytic hydrotreatment conditions comprise a temperature of in the range of 290° C. to 425° C., a hydrogen pressure in the range of from 80 to 200 bar, a space velocity of 0.5 to 1.5 $t/m^3h$ and a hydrogen/oil ratio in the range of between 300 and 5,000 standard liters per kilogram of said oil.

9. The process of claim 1 wherein said catalytic hydrotreatment conditions comprise a temperature in the range of 325° C. to 380° C., a hydrogen pressure in the range of from 100 to 150 bar, a space velocity of 0.5 to 1.2 $t/m^3h$ and a hydrogen/oil ratio in the range of between 500 and 2,000 standard liters per kilogram of said oil.

10. The process of claim 1 wherein said hydrotreatment catalyst comprises one or more metals of Group VIB and VIII of the Periodic Table of Elements disposed on a carrier comprising one or more oxides of elements of Groups II, III and IV of the Periodic Table of Elements.

11. The process of claim 10 wherein said hydrotreatment catalyst is present in a sulfide form.

12. The process of claim 10 wherein hydrotreatment catalyst contains at least 10 parts by weight of a Group VIIB metal or at least 3 parts by weight of a Group VIII metal or combination of at least 10 parts by weight of said Group VIIB metal and at least 3 forth by weight of said Group VIII metal per 100 parts by weight of said carrier.

13. The process of claim 10 wherein said hydrotreatment catalyst is a xerogel containing 3 to 12 parts by weight of nickel and 20 to 75 parts by weight tungsten per 100 parts by weight of said carrier.

14. The process of claim 10 wherein said hydrotreatment catalyst is a hydrogel containing 25 to 50 parts by weight of nickel and 50 to 80 parts by weight tungsten per 100 parts by weight of said alumina.

15. The process of claim 13 wherein said hydrotreatment catalyst comprises an alumina carrier and 0.5 to 10 parts by weight fluorine per 100 parts by weight of said alumina.

16. The process of claim 14 wherein said catalyst comprises 10 to 25 parts by weight fluorine per 100 parts by weight alumina.

17. The process of claim 1 further characterized in that dewaxing treatment comprises solvent dewaxing with a solvent comprising methylethyl ketone.

18. The process of claim 17 wherein said solvent is present in association with toluene.

19. The process of claim 1 wherein said dewaxing treatment comprises catalytic in the presence of hydrogen and a catalytic composition of matter having dewaxing activity.

20. The process of claim 19 wherein said catalytic composition of matter for catalytic dewaxing comprises a crystalline aluminum silicate selected from the group consisting essentially of a ZSM-5, ZSM-8, ZSM-11, ZSM-23, ZSM-35 and ferrierite.

21. A process for the preparation of lubricating base oils from a nitrogen-containing distillate oil or a nitrogen-containing deasphalted oil having a nitrogen content which numerically exceeds the value of $(f)(P_{H2})(S_v)^{-1}$ wherein said process comprises:

(a) solvent extracting said oil in the presence of an extraction solvent selected from the group consisting of furfural, phenol and N-methyl-2-pyrrolidine, at solvent extraction conditions, to reduce said numerial value to 0.3 to 0.95 times the value of said nitrogen content determined by the formula of $(f)(P_{H2})(S_v)^{-1}$ (b) hydrotreating solvent extracted oil in a hydrotreatment zone at hydrotreatment conditions in the presence of a hydrotreatment catalyst to selectively hydrotreat said oil; and (c) dewaxing said hydrotreated oil, at dewaxing conditions, in a dewaxing zone to recover a dewaxed oil, $f$=is equal to $2.15+0.12\times V_{100}$ wherein $V_{100}$ is equal to the kinematic viscosity of the resultant lubricating base oil expressed in centistokes (cSt) at 100° C.;

$P_{H2}$=is equal to hydrogen partial pressure in bar existent in said catalytic hydrotreatment zone; and $S_v$=is equal to weight hourly space velocity in $t/m^3(h)$ in said catalytic hydrotreatment zone.

* * * * *